US009758177B2

(12) United States Patent
Takada

(10) Patent No.: US 9,758,177 B2
(45) **Date of Patent: *Sep. 12, 2017**

(54) ARTICLE TRANSPORT FACILITY

(71) Applicant: Daifuku Co., Ltd., Osaka-shi (JP)

(72) Inventor: Ayato Takada, Shiga (JP)

(73) Assignee: Daifuku Co., Ltd., Osaka-shi (JP)

( * ) Notice: Subject to any disclaimer, the term of this patent is extended or adjusted under 35 U.S.C. 154(b) by 42 days.

This patent is subject to a terminal disclaimer.

(21) Appl. No.: 15/076,751

(22) Filed: Mar. 22, 2016

(65) Prior Publication Data

US 2016/0280239 A1 Sep. 29, 2016

(30) Foreign Application Priority Data

Mar. 26, 2015 (JP) ..... 2015-064736

(51) Int. Cl.
*B61B 3/00* (2006.01)
*B61B 3/02* (2006.01)

(52) U.S. Cl.
CPC ..... *B61B 3/02* (2013.01)

(58) Field of Classification Search
CPC . A63H 18/12; B60L 5/005; B60L 5/39; B60L 2200/26; B60L 23/002; B61B 13/00; B61B 13/04; B61B 13/08; B61B 13/127; B61B 1/00; H01L 21/67715; H01L 21/67727; H01L 21/6773; H01L 21/67733; H01L 21/67736; H01L 21/67259
USPC ... 104/88.01–88.04, 89, 90, 91, 96, 97, 288, 104/287, 300, 130.01; 105/52–54, 61
See application file for complete search history.

(56) References Cited

U.S. PATENT DOCUMENTS 5,540,319 A * 7/1996 Orisaka ..... B61B 13/127 198/465.2
5,794,534 A * 8/1998 Enderlein ..... B07C 3/08 104/89
6,220,173 B1 * 4/2001 Sauerwein ..... B61L 23/002 104/106
6,591,961 B2 * 7/2003 Fukushima ..... B61B 13/00 198/346.1
6,629,502 B2 * 10/2003 Matsukawa ..... E01B 25/06 104/130.01
6,655,297 B2 * 12/2003 Kawato ..... B61J 1/06 104/96

(Continued)

FOREIGN PATENT DOCUMENTS

JP 2013184762 A 9/2013

*Primary Examiner* — Jason C Smith
(74) *Attorney, Agent, or Firm* — The Webb Law Firm

(57) ABSTRACT

A sub-path is connected to a first main path and a second main path along which an article transport vehicle travels in a direction opposite to that of the first main path. The sub-path includes an intersection portion, a first upstream path connected to the first main path and the intersection portion, a second upstream path connected to the second main path and the intersection portion, a first downstream path connected to the intersection portion and the second main path, and a second downstream path connected to the intersection portion and the first main path. In the intersection portion, a first connection path that connects the first upstream path and the first downstream path, and a second connection path that connects the second upstream path and the second downstream path are provided so as to be located at the same height and to intersect each other.

16 Claims, 11 Drawing Sheets

(56) References Cited

U.S. PATENT DOCUMENTS 6,851,913 B2 * 2/2005 Iizuka ..... B66C 1/28 414/626
7,210,589 B2 * 5/2007 Iizuka ..... B66C 13/06 212/270
7,845,284 B2 * 12/2010 Izumi ..... B65G 17/20 104/88.02
8,245,647 B2 * 8/2012 Oguro ..... H01L 21/67715 104/130.01
8,322,287 B2 * 12/2012 Oguro ..... B65G 37/02 104/88.01
2002/0104726 A1 * 8/2002 Kuzuya ..... B60L 5/005 191/6
2003/0077159 A1 * 4/2003 Iizuka ..... B66C 1/28 414/609
2004/0025739 A1 * 2/2004 Matsukawa ..... E01B 25/06 104/96
2004/0253087 A1 * 12/2004 Iizuka ..... B66C 13/06 414/626
2005/0005808 A1 * 1/2005 Wakabayashi .... H01L 21/67276 104/88.01
2005/0139114 A1 * 6/2005 Nakao ..... B61B 13/04 104/96
2006/0016363 A1 * 1/2006 Nakao ..... G05D 1/0229 104/88.01
2006/0230975 A1 * 10/2006 Shiwaku ..... B61B 1/00 104/88.01
2009/0000505 A1 * 1/2009 Shimamura ..... B61B 13/00 104/88.02
2010/0242783 A1 * 9/2010 Oguro ..... B65G 37/02 104/91
2010/0242784 A1 * 9/2010 Oguro ..... H01L 21/67715 104/130.01
2011/0061559 A1 * 3/2011 Lund ..... B60L 5/36 104/119
2012/0305364 A1 * 12/2012 Morimoto ..... H01L 21/67727 198/370.01
2012/0312188 A1 * 12/2012 Inui ..... B60L 5/005 104/288
2013/0213755 A1 * 8/2013 Shibata ..... B61B 3/02 191/22 R
2015/0020343 A1 * 1/2015 Shibata ..... B65G 45/22 15/306.1
2016/0031460 A1 * 2/2016 Izumi ..... B61B 13/00 104/88.01
2016/0240417 A1 * 8/2016 Tomida ..... B66C 15/045
2016/0257498 A1 * 9/2016 Murakami ..... B61B 3/02
2016/0280239 A1 * 9/2016 Takada ..... B61B 3/02
2016/0288802 A1 * 10/2016 Kinugawa ..... B61B 3/02
2016/0332523 A1 * 11/2016 Wada ..... B60L 5/005
2017/0002523 A1 * 1/2017 Ogisu ..... E01B 11/42
2017/0008700 A1 * 1/2017 Wada ..... B61B 3/02

* cited by examiner

ARTICLE TRANSPORT FACILITY

CROSS-REFERENCE TO RELATED APPLICATION

This application claims priority to Japanese Patent Application No. 2015-064736 filed Mar. 26, 2015, the disclosure of which is hereby incorporated in its entirety by reference.

FIELD OF THE INVENTION

The present invention relates to an article transport facility including, as traveling paths, a first main path that is formed in a loop shape, a second main path that is formed in a loop shape, and a sub-path that connects the first main path and the second main path, the article transport facility being configured to transport an article by an article transport vehicle that travels along the traveling paths only in the direction of forward movement.

BACKGROUND

An example of the article transport facility including a plurality of main paths as described above is disclosed in JP 2013-184762A. In FIG. 1 of the patent document, a plurality of relatively small loop-shaped paths correspond to the first main path and the second main path, and those paths included in a relatively big loop-shaped path that connect the small loop-shaped paths correspond to the sub-path. Along the small loop-shaped paths corresponding to the first main path and the second main path, the article transport vehicle travels in the same direction in a circulating manner.

In such an article transport facility, the circulating direction of the article transport vehicle along the first main path and the circulating direction of the article transport vehicle along the second main path may be opposite. In this case, it is conceivable to connect a sub-path 107 to a first main path 105 and a second main path 106 as shown in FIG. 10. That is, it is conceivable that the sub-path 107 includes a first sub-path 107*a* along which the article transport vehicle travels from the first main path 105 toward the second main path 106, and a second sub-path 107*b* along which the article transport vehicle travels from the second main path 106 toward the first main path 105, and the first sub-path 107*a* and the second sub-path 107*b* are arranged along the path width direction (Y) of the sub-path 107.

However, the ends of the first sub-path 107*a* and the ends of the second sub-path 107*b* are formed in an arc shape in plan view so as to allow the article transport vehicle to smoothly transfer between the first main path 105 and the second main path 106. Accordingly, in the case of arranging the first sub-path 107*a* and the second sub-path 107*b* in the path width direction of the sub-path 107 in this way, a wide space (W2) is required in the path width direction (Y) to provide the sub-path 107. It is also conceivable that, as shown in FIGS. 11 and 12, the arc-shaped ends of the first sub-path 107*a* and the second sub-path 107*b* are arranged in an inclined orientation, and the linear portion of the first sub-path 107*a* and the linear portion of the second sub-path 107*b* are arranged in the vertical direction so as to be positioned in a stepped manner. However, when the first sub-path 107*a* and the second sub-path 107*b* are positioned so as to be arranged in the vertical direction in this way, a wide space is required in the vertical direction Z to provide the sub-path 107. Also, the sub-path 107 has a three-dimensional intersection structure, and becomes more complex.

SUMMARY OF THE INVENTION

Therefore, there is a need for an article transport facility that allows the sub-path to be provided in a space that is narrow in the width direction and the vertical direction.

According to an aspect, an article transport facility includes:

as traveling paths, a first main path that is formed in a loop shape, a second main path that is formed in a loop shape separately from the first main path, and a sub-path that connects the first main path and the second main path, the article transport facility being configured to transport an article by an article transport vehicle that travels along the traveling paths only in a direction of forward movement, wherein the sub-path includes a first sub-path connected to the first main path at a first connection portion, and a second sub-path connected to the second main path at a second connection portion, a direction of arrangement of the first main path and the second main path is set to be a longitudinal direction, a direction extending from the second main path toward the first main path in the longitudinal direction is set to be a first longitudinal direction, and a direction extending from the first main path toward the second main path in the longitudinal direction is set to be a second longitudinal direction, a direction orthogonal to the longitudinal direction in plan view is set to be a width direction, one direction extending along the width direction is set to be a first width direction, and another direction extending along the width direction is set to be a second width direction, the first main path and the second main path are paths along which the article transport vehicle travels in directions opposite to each other, the sub-path includes:

an intersection portion that is located between the first main path and the second main path in the longitudinal direction and in which the first sub-path and the second sub-path intersect each other;

a first upstream path whose end on the first longitudinal direction side is connected to the first connection portion and whose end on the second longitudinal direction side is connected to the intersection portion;

a second upstream path whose end on the second longitudinal direction side is connected to the second connection portion and whose end on the first longitudinal direction side is connected to the intersection portion;

a first downstream path that is located on the first width direction side with respect to the second upstream path, and whose end on the first longitudinal direction side is connected to the intersection portion and whose end on the second longitudinal direction side is connected to a first different path different from the first main path at a third connection portion; and a second downstream path that is located on the first width direction side with respect to the first upstream path, and whose end on the second longitudinal direction side is connected to the intersection portion and whose end on the first longitudinal direction side is connected to a second different path different from the second main path at a fourth connection portion, the first upstream path and the first downstream path are paths along which the article transport vehicle travels in the second longitudinal direction, the second upstream path and the second downstream path are paths along which the article transport vehicle travels in the first longitudinal direction, the intersection portion includes a first connection path that connects the end on the second longitudinal direction side of the first upstream path and the end on the first longitudinal direction side of the first downstream path, and a second connection path that connects the end on the first longitudinal direction side of the second upstream path and the end on the second longitudinal direction side of the second downstream path, and the first connection path and the second connection path are provided so as to be located at the same height and to intersect each other.

With this configuration, the article transport vehicle that has branched off from the first connection portion of the first main path to the first upstream path of the sub-path travels along the sub-path, starting at the first upstream path, then the intersection portion and the first downstream path in this order, and thereafter merges with the second main path or travels along a first different path. The article transport vehicle that has branched off from the second connection portion of the second main path to the second upstream path of the sub-path travels along the sub-path, starting at the second upstream path, then the intersection portion and the second downstream path in this order, and thereafter merges with the first main path or travels along a second different path.

The path (the first upstream path, the intersection portion, and the first downstream path) along which the article transport vehicle that has branched off from the first main path travels and the path (the second upstream path, the intersection portion, and the second downstream path) along which the article transport vehicle that has branched off from the second main path travels intersect each other in the intersection portion at the same height. Therefore, it is possible to provide the first upstream path close to the second downstream path in the second width direction, and provide the first downstream path close to the second upstream path in the first width direction.

Accordingly, even when the end on the first longitudinal direction side of the first upstream path that is connected to the first main path and the end of the second upstream path that is connected to the second main path are formed in an arc shape in plan view so as to allow the article transport vehicle to smoothly branch off, it is not necessary to significantly shift these ends in the width direction of the sub-path. Thus, it is possible to provide the sub-path without requiring a wide space in the width direction. Also, even when these ends are provided at the same position in the width direction, the path (the first upstream path, the intersection portion, and the first downstream path) of the sub-path along which the article transport vehicle that has branched off from the first main path travels and the path (the second upstream path, the intersection portion, and the second downstream path) thereof along which the article transport vehicle that has branched off from the second main path travels do not need to be set so as to be shifted in the vertical direction. Accordingly, it is possible to provide the sub-path without requiring a wide space in the vertical direction as well, and also prevent the structure from becoming complex due to a three-dimensional intersection or the like. In this way, according to the present configuration, it is possible to provide the sub-path in a space that is narrow in the path width direction and the vertical direction.

Further features and advantages of the article transport facility will become apparent from the following description of embodiments with reference to the drawings.

DETAILED DESCRIPTION

Figure 1:
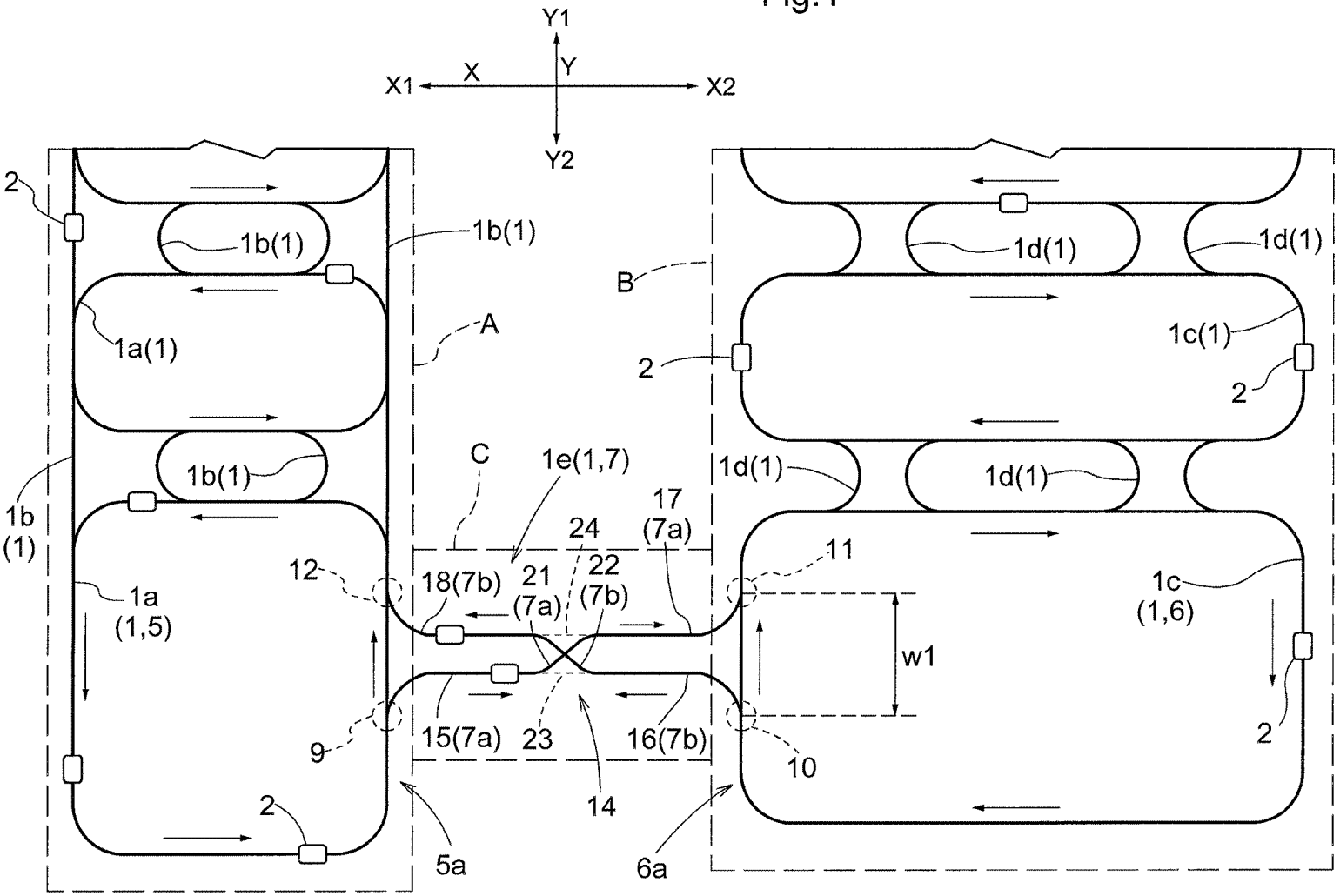
FIG. 1 is a diagram showing traveling paths according to an embodiment.

Hereinafter, an embodiment of an article transport facility according to the present invention will be described with reference to the drawings. As shown in FIG. 1, the article transport facility is installed across a first area A and a second area B, and the first area A and the second area B are connected by a connecting area C. Note that each of the first area A, the second area B, and the connecting area C is a clean room. An article transport vehicle 2 that transports an article by traveling along a traveling path 1 only in the direction of forward movement, and a traveling rail 3 (see FIGS. 2 and 3, etc.) installed along the traveling path 1 are installed in the article transport facility. The traveling rail 3 is suspended and supported from the ceiling. Note that in the present embodiment, the article is a FOUP (Front Opening Unified Pod) that accommodates semiconductor substrates.

The traveling path 1 set in the first area A includes a plurality of first loop-shaped paths 1*a* that are configured in a loop shaped, and a plurality of first transit paths 1*b* that are connected to two adjacent first loop-shaped paths 1*a*. The traveling path 1 set in the second area B includes a plurality of second loop-shaped paths 1*c* that are configured in a loop shape, and a plurality of second transit paths 1*d* that are connected to two adjacent second loop-shaped paths 1*c*. Although not shown, a warehouse that stores articles and a processing device that performs processing on the semiconductor substrates stored in the articles are installed along the first loop-shaped paths 1*a* and the second loop-shaped paths 1*c*.

The traveling paths 1 include a third transit path 1*e* that is connected to one first loop-shaped path 1*a* in the first area A and one second loop-shaped path 1*c* in the second area B. Note that the third transit path 1*e* is referred to as "sub-path 7" in the following description. Also, the first loop-shaped path 1*a* connected to the third transit path 1*e* is referred to as "first main path 5", and the second loop-shaped path 1*c* connected to the third transit path 1*e* is referred to as "second main path 6". That is, in the present embodiment, as the traveling paths 1, a first main path 5 that is configured in a loop shape, a second main path 6 that is configured in a loop shape separately from the first main path, and a sub-path 7 that connects the first main path and the second main path are provided. Note that the sub-path 7 is connected to a first connection portion 9 of the first main path 5 and is also connected to a second connection portion 10 of the second main path 6.

As indicated by the arrows in FIG. 1, the article transport vehicle 2 travels counterclockwise along the first main path 5, whereas the article transport vehicle 2 travels clockwise along the second main path 6. In this way, the first main path 5 serves as a path along which the article transport vehicle 2 travels in a direction opposite to the direction in which the article transport vehicle 2 travels along the second main path 6. That is, the first main path 5 and the second main path 6 are paths along which the article transport vehicle 2 travels directions opposite to each other.

Here, "directions" as used in the following description will be described. As shown in FIG. 1, the direction of arrangement of the first main path 5 and the second main path 6 (in the present embodiment, this direction is equivalent to the direction of arrangement of the first connection portion 9 and the second connection portion 10 as shown in FIG. 1) is "longitudinal direction X". A direction that is one direction along the longitudinal direction X and extends from the second main path 6 toward the first main path 5 in the longitudinal direction X (direction extending from the second connection portion 10 toward the first connection portion 9) is "first longitudinal direction X1". A direction that is the other direction along the longitudinal direction X and extends from the first main path 5 toward the second main path 6 in the longitudinal direction X (direction extending from the first connection portion 9 toward the second connection portion 10) is "second longitudinal direction X2". Further, a direction orthogonal to the longitudinal direction X in plan view is "width direction Y", one direction along the width direction Y is "first width direction Y1", and the other direction along the width direction Y is "second width direction Y2".

The first main path 5 is located in the first longitudinal direction X1 with respect to the second main path 6. Of the first main path 5, a path that is provided linearly along the width direction Y and along which the article transport vehicle 2 travels toward the first width direction Y1 is referred to as "first width direction path 5*a*". In the first width direction path 5*a*, a first connection portion 9 that branches off from the first main path 5 to the sub-path 7 and a fourth connection portion 12 that merges with the first main path 5 from the sub-path 7 are provided. Of the second main path 6, a path that is provided linearly along the width direction Y and along which the article transport vehicle 2 travels toward the first width direction Y1 is referred to as "second width direction path 6*a*". In the second width direction path 6*a*, a second connection portion 10 at which the article transport vehicle 2 branches off from the second main path 6 to the sub-path 7 and a third connection portion 11 at which the article transport vehicle 2 merges with the second main path 6 from the sub-path 7 are provided. In this way, the article transport vehicle 2 travels in the same direction along the first width direction path 5*a* of the first main path 5 and the second width direction path 6*a* of the second main path 6 to which the sub-path 7 is connected.

In other words, the first width direction Y1 is a direction in which the article transport vehicle 2 travels along the width direction Y in each of the path (first width direction path 5*a*) of the first main path 5 that opposes the second main path 6 and the path (second width direction path 6*a*) of the second main path 6 that opposes the first main path 5. Also, the first connection portion 9 and the fourth connection portion 12 are provided in the path (first width direction path 5*a*) of the first main path 5 along which the article transport vehicle 2 travels in the first width direction Y1. The second connection portion 10 and the third connection portion 11 are provided in the path (second width direction path 6*a*) of the second main path 6 along which the article transport vehicle 2 travels in the first width direction Y1.

It can be said that the sub-path 7 includes the first sub-path 7*a* that is connected to the first main path 5 at the first connection portion 9, and the second sub-path 7*b* that is connected to the second main path 6 at the second connection portion 10. The first sub-path 7*a* is a path including reference numerals "15, 21, and 17" in FIG. 1, and the second sub-path 7*b* is a path including reference numerals "16, 22, and 18" in FIG. 1. As will be described below, the path structure also includes a path including reference numerals "15, 23, and 16" and a path including reference numerals "17, 24, and 18". However, the article transport vehicle 2 will not travel along these paths in the present embodiment.

The sub-path 7 as a whole is provided linearly along the longitudinal direction X. As shown in FIG. 1, the sub-path 7 includes an intersection portion 14, a first upstream path 15, a second upstream path 16, a first downstream path 17, and a second downstream path 18. The intersection portion 14 is a portion that is located between the first main path 5 and the second main path 6 in the longitudinal direction X and in which the first sub-path 7*a* and the second sub-path 7*b* intersect each other. The first upstream path 15 and the second downstream path 18 are located between the first main path 5 and the intersection portion 14 in the longitudinal direction X. The second downstream path 18 is provided so as to be parallel to the first upstream path 15, and is located on the first width direction Y1 side with respect to the first upstream path 15. The second upstream path 16 and the first downstream path 17 are located between the second main path 6 and the intersection portion 14 in the longitudinal direction X. The first downstream path 17 is provided so as to be parallel to the second upstream path 16, and is located on the first width direction Y1 side with respect to the second upstream path 16.

The first upstream path 15 and the second upstream path 16 are provided on a straight line, and the first downstream path 17 and the second downstream path 18 are also provided on a straight line. The intersection portion 14, the first upstream path 15, the second upstream path 16, the first downstream path 17, and the second downstream path 18 are provided at the same height (provided on the same plane).

The end on the first longitudinal direction X1 side of the first upstream path 15 is connected to the first connection portion 9 of the first width direction path 5*a* in the first main path 5, and the end on the second longitudinal direction X2 side thereof is connected to the intersection portion 14. The end on the first longitudinal direction X1 side of the first downstream path 17 is connected to the intersection portion 14, and the end on the second longitudinal direction X2 side thereof is connected to the third connection portion 11 of the second width direction path 6*a* in the second main path 6.

The end on the second longitudinal direction X2 side of the second upstream path 16 is connected to the second connection portion 10 of the second width direction path 6*a* in the second main path 6, and the end on the first longitudinal direction X1 side thereof is connected to the intersection portion 14. The end on the second longitudinal direction X2 side of the second downstream path 18 is connected to the intersection portion 14, and the end on the first longitudinal direction X1 side thereof is connected to the fourth connection portion 12 of the first width direction path 5*a* in the first main path 5.

The first upstream path 15 and the first downstream path 17 are paths (first sub-paths 7*a*) along which the article transport vehicle 2 travels in the second longitudinal direction X2. The second upstream path 16 and the second downstream path 18 are paths (second sub-paths 7*b*) along which the article transport vehicle 2 travels in the first longitudinal direction X1.

Each of the end on the first longitudinal direction X1 side of the first upstream path 15, the end on the second longitudinal direction X2 side of the second upstream path 16, the end on the first longitudinal direction X1 side of the first downstream path 17, and the end on the second longitudinal direction X2 side of the second downstream path 18 constitutes an arc-shaped path at its part connecting to the first main path 5 or the second main path 6. Specifically, each of these ends constitutes an arc-shaped path so as to have a shape extending along the width direction Y at its part connecting to the main path (5, 6) and extending along the longitudinal direction X at its part connecting to the sub-path 7. In the present embodiment, the first connection portion 9 and the second connection portion 10 are provided at the same position in the width direction Y, and the third connection portion 11 and the fourth connection portion 12 are provided at the same position in the width direction Y. The third connection portion 11 is located on the first width direction Y1 side with respect to the second connection portion 10, and the fourth connection portion 12 is located on the first width direction Y1 side with respect to the first connection portion 9.

In the intersection portion 14, a first connection path 21 that connects the end on the second longitudinal direction X2 side of the first upstream path 15 and the end on the first longitudinal direction X1 side of the first downstream path 17, and a second connection path 22 that connects the end on the first longitudinal direction X1 side of the second upstream path 16 and the end on the second longitudinal direction X2 side of the second downstream path 18 are provided. In the intersection portion 14, a third connection path 23 that connects the end on the second longitudinal direction X2 side of the first upstream path 15 and the end on the first longitudinal direction X1 side of the second upstream path 16, and a fourth connection path 24 that connects the end on the second longitudinal direction X2 side of the second downstream path 18 and the end on the first longitudinal direction X1 side of the first downstream path 17 are also provided. The first connection path 21, the second connection path 22, the third connection path 23, and the fourth connection path 24 are provided at the same height (provided on the same plane).

The first connection path 21 is provided obliquely to the longitudinal direction X so as to be located further to the first width direction Y1 in the direction from the end on the second longitudinal direction X2 of the first upstream path 15 toward the first longitudinal direction X1. The second connection path 22 is provided obliquely to the longitudinal direction X so as to be located further to the second width direction Y2 in the direction from the end on the second longitudinal direction X2 of the second downstream path 18 toward the first longitudinal direction X1. Further, the first connection path 21 and the second connection path 22 are provided so as to intersect each other in plan view.

The third connection path 23 is provided linearly along the longitudinal direction X so as to link the end in the second longitudinal direction X2 of the first upstream path 15 with the end in the first longitudinal direction X1 of the second upstream path 16. The fourth connection path 24 is provided linearly along the longitudinal direction X so as to link the end in the second longitudinal direction X2 of the second downstream path 18 with the end in the first longitudinal direction X1 of the first downstream path 17. That is, the first upstream path 15, the third connection path 23, and the second upstream path 16 are provided on a straight line, and the first downstream path 17, the fourth connection path 24, and the second downstream path 18 are also provided on a straight line. Note that the article transport vehicle 2 does not travel along the third connection path 23 and the fourth connection path 24 in the article transport facility of the present embodiment as described above. Accordingly, the third connection path 23 and the fourth connection path 24 are indicated by the broken lines in FIG. 1.

When traveling from the first main path 5 to the second main path 6, the article transport vehicle 2 branches off at the first connection portion 9 of the first main path 5 to travel to the first upstream path 15 of the sub-path 7, and thereafter travels along the intersection portion 14 (first connection path 21) and the first downstream path 17 of the sub-path 7, and merges with the second main path 6 at the third connection portion 11 of the second main path 6. When traveling from the second main path 6 to the first main path 5, the article transport vehicle 2 branches off at the second connection portion 10 of the second main path 6 to travel to the second upstream path 16 of the sub-path 7, and thereafter travels along the intersection portion 14 (second connection path 22) and the second downstream path 18 of the sub-path 7, and merges with the first main path 5 at the fourth connection portion 12 of the first main path 5.

Next, the article transport vehicle 2 will be described. In the description of the article transport vehicle 2, the front-rear direction of the article transport vehicle 2 is referred to as "vehicle front-rear direction", and the lateral width direction of the article transport vehicle 2 is referred to as "vehicle lateral width direction". The left-right direction is identified in a state in which the article transport vehicle 2 is viewed from the rear to the front. As for the traveling path 1, the direction along the traveling path 1 is referred to as "path longitudinal direction", and a direction orthogonal to the path longitudinal direction in plan view is referred to as "path lateral width direction".

Figure 2:
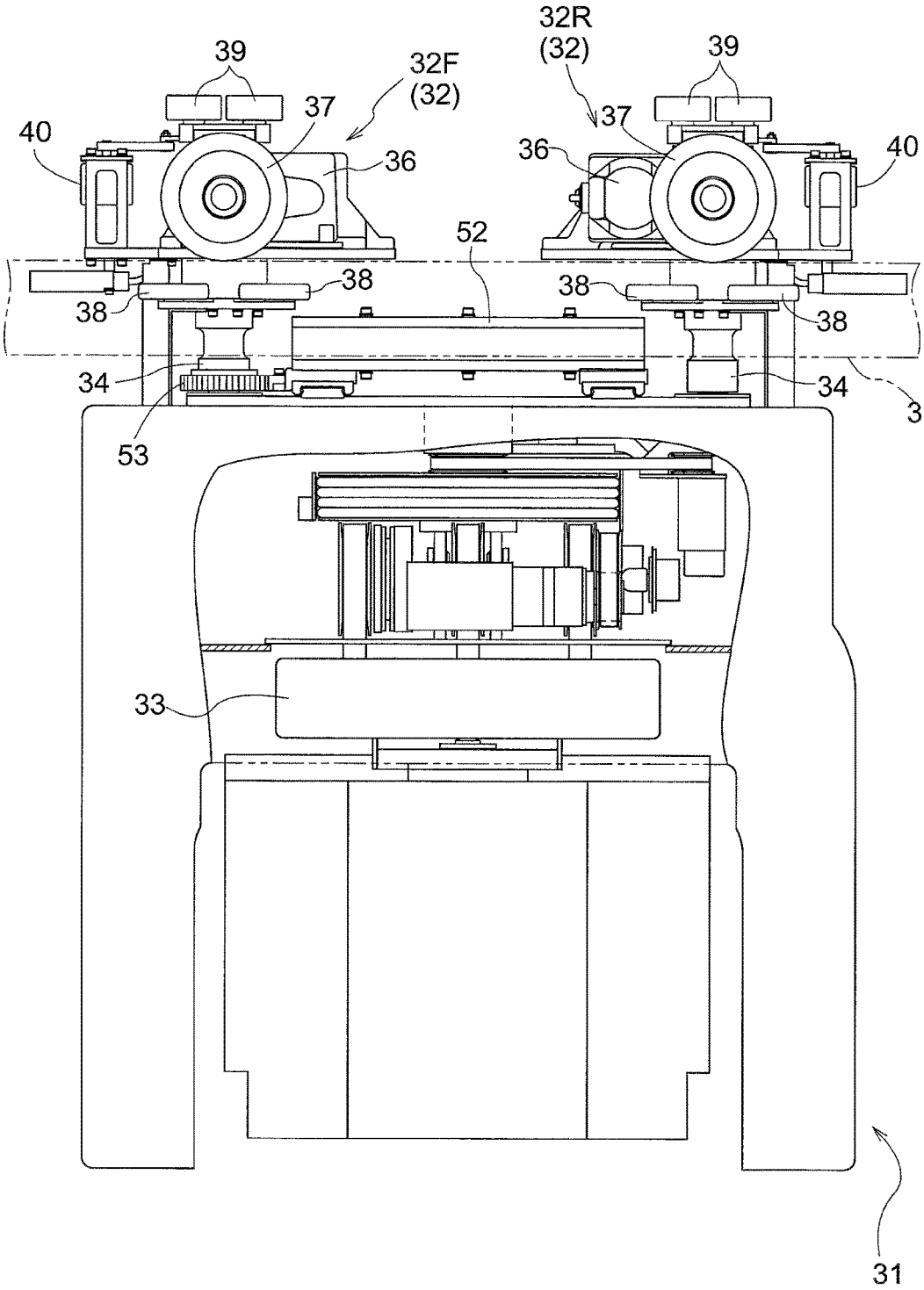
FIG. 2 is a side view of an article transport vehicle.
Figure 3:
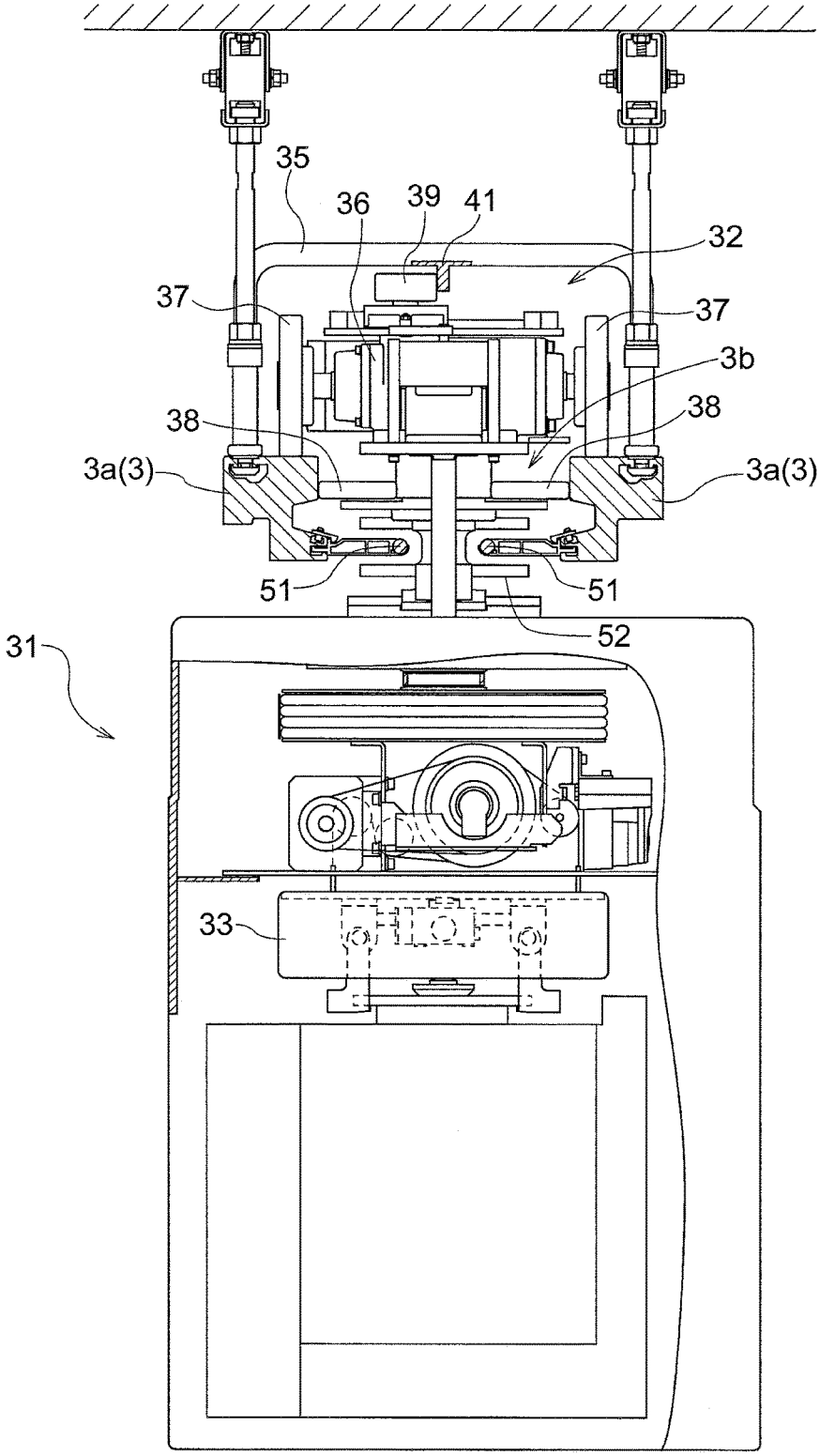
FIG. 3 is a front view of the article transport vehicle.

As shown in FIGS. 2 and 3, the article transport vehicle 2 includes a traveling portion 32 that travels on a traveling rail 3 suspended and supported from the ceiling along the traveling rail 3, a vehicle body portion 31 that is located below the traveling rail 3 and suspended and supported by the traveling portion 32, and a coupling portion 34 that couples the traveling portion 32 and the vehicle body portion 31. The vehicle body portion 31 includes a supporting portion 33 that supports an article in a suspended state, and the traveling portion 32 and the vehicle body portion 31 are coupled by the coupling portion 34. Note that a pair of left and right rail portions 3*a* are coupled by a rail support member 35 that is formed in an inverted U-shape as viewed in the path longitudinal direction, and are suspended and supported by the ceiling portion via the rail support member 35.

The traveling portion 32 is composed of a front traveling portion 32F and a rear traveling portion 32R that are arranged in the vehicle front-rear direction. Also, the vehicle body portion 31 is coupled to each of a pair of front and rear coupling portions 34 so as to be rotatable about the longitudinal axis, and each of the front traveling portion 32F and the rear traveling portion 32R is configured to rotate about the longitudinal axis together with the coupling portion 34 to which it is coupled. The pair of front and rear coupling portions 34 are located between the pair of left and right rail portions 3*a* that constitute the traveling rail 3.

A pair of left and right traveling wheels 37 that are rotationally driven by an electrically powered drive motor 36 are mounted to the front traveling portion 32F so as to travel on traveling surfaces formed by the respective top surfaces of the pair of left and right rail portions 3*a*, and a pair of left and right guide wheels 38 that are freely rotated about the axis extending along the vehicle vertical width direction (about the vertical axis) are mounted in contact with the inner surfaces of the pair of left and right rail portions 3*a*. Note that two sets of the pair of left and right guide wheels 38 are mounted to the front traveling portion 32F so as to be arranged in the vehicle front-rear direction. Note that as with the front traveling portion 32F, a set of the pair of left and right traveling wheels 37 and two sets of the pair of left and right guide wheels 38 are mounted to the rear traveling portion 32R.

A power receiving portion 52 to which driving power is supplied in a non-contact manner from feeding lines 51 respectively installed along the pair of left and right rail portions 3*a* is provided on the top surface of the vehicle body portion 31. The power receiving portion 52 is provided so as to be located between the pair of front and rear coupling portions 34 in the vehicle front-rear direction, and is located within a communicating portion 3*b* formed in the traveling rail 3. Although the detailed description has been omitted, the power receiving portion 52 is supported so as to be slidably moved in the vehicle lateral width direction, and the front traveling portion 32F and the power receiving portion 52 is operatively coupled by an interlocking mechanism 53 such that the power receiving portion 52 is slidably moved in the vehicle lateral width direction synchronously with the rotation of the front traveling portion 32F about the longitudinal axis.

The article transport vehicle 2 travels on the traveling rail 3 by a driving force applied as a result of the traveling wheels 37 of the front traveling portion 32F and the rear traveling portion 32R being rotatably driven. At this time, the position in the vehicle lateral width direction is limited by the guide wheels 38 of the front traveling portion 32F and the rear traveling portion 32R being guided by the pair of rail portions 3*a*. Consequently, the article transport vehicle 2 travels along the traveling path 1. Further, in the article transport vehicle 2, the front traveling portion 32F and the rear traveling portion 32R are pivoted relative to the vehicle body portion 31 about the axis extending along the vehicle vertical width direction with respect to the coupling portions 34. This allows the article transport vehicle 2 to travel along the traveling path 1 even when the traveling path 1 is arc-shaped (e.g., the end in the first longitudinal direction X1 of the first upstream path 15).

Figure 4:
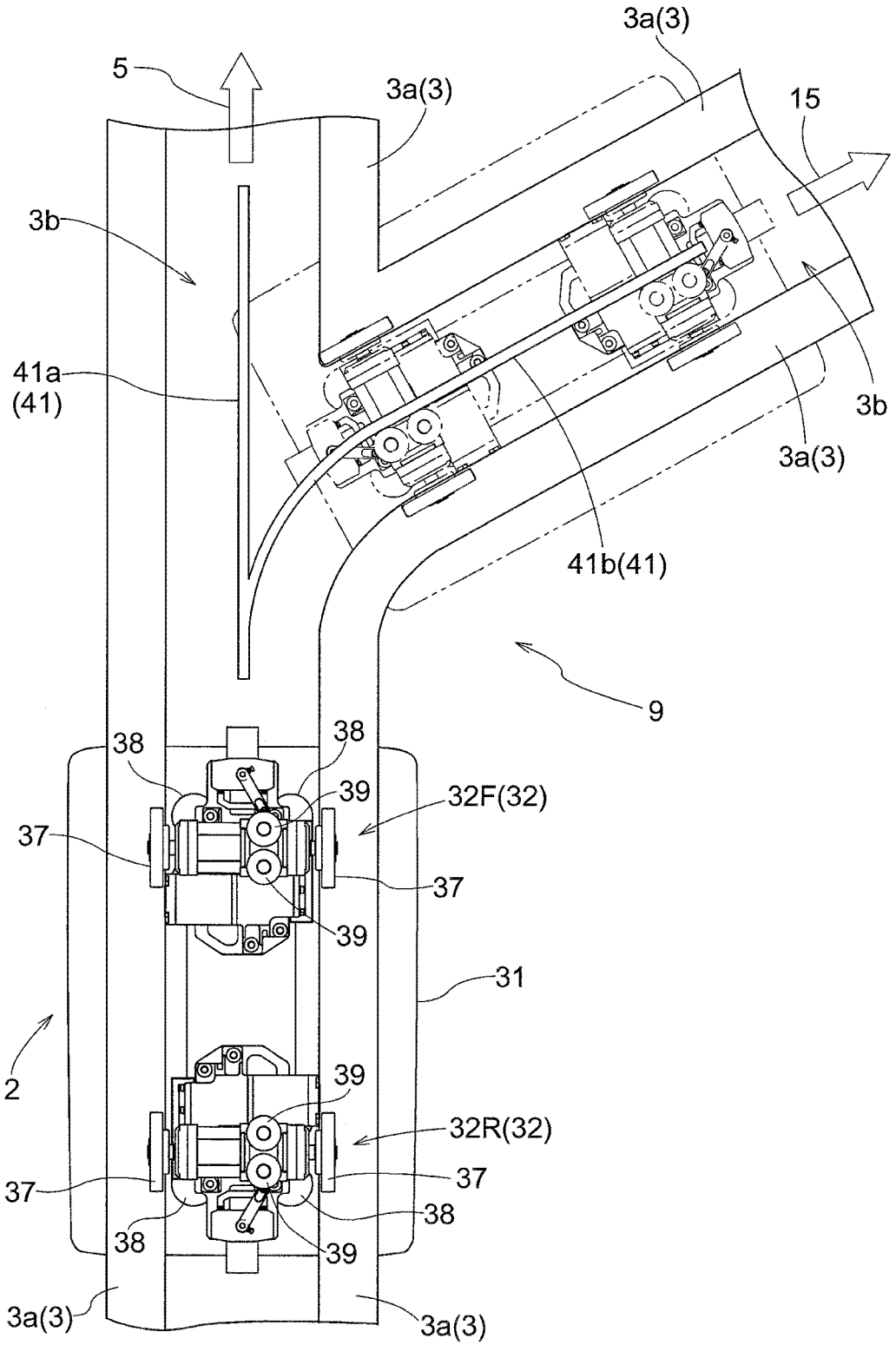
FIG. 4 is a plan view of a first connection portion.

The coupling portions 34 and the pair of left and right guide wheels 38 are located between the pair of left and right rail portions 3*a* so as to be arranged in the vehicle lateral width direction (rail lateral width direction). By installing the pair of left and right rail portions 3*a* so as to be spaced apart in the path lateral width direction, the upper space and the lower space of the traveling rail 3 are brought into communication, thus forming a communicating portion 3*b* in which the coupling portions 34 and a pair of left and right guide members 28 are located (see FIG. 3). The communicating portion 3*b* is formed so as to be continuous along the traveling path 1. In a location where two paths are connected or intersect each other, the communicating portions 3*b* that are formed along the respective paths are connected with each other. For example, as shown in FIG. 4, the communicating portion 3*b* formed along the first main path 5 and the communicating portion 3*b* formed along the first upstream path 15 are connected at the first connection portion 9.

The pair of rail portions 3*a* are installed continuously along the traveling path 1. However, in a location where two paths are connected or intersect each other, at least one of the pair of left and right rail portions 3*a* is broken at a broken location and is discontinuous. That is, at least one of the pair of left and right rail portions 3*a* installed along each of the two paths has a discontinuous section in which it is broken in the path longitudinal direction at a broken location and is discontinuous. For example, at the first connection portion 9, one rail portion 3*a* (the rail portion 3*a* on the side (the right side) where the first upstream path 15 is present) of the pair of left and right rail portions 3*a* installed along the first main path 5 is broken in the path longitudinal direction, as shown in FIG. 4. That is, the aforementioned rail portion 3*a* is broken in the path longitudinal direction in order to provide communication between the communicating portion 3*b* formed along the first main path 5 and the communicating portion 3*b* formed along the first upstream path 15.

As shown in FIGS. 2 and 3, a pair of front and rear auxiliary guide wheels 39 that rotate about the vertical axis (the axis along the vehicle vertical width direction) and a driving portion 40 that moves the pair of front and rear auxiliary guide wheels 39 together in the vehicle lateral width direction are mounted to the front traveling portion 32F at a location above the traveling wheels 37. Note that a pair of front and rear auxiliary guide wheels 39 and a driving portion 40 are mounted to the rear traveling portion 32R as with the front traveling portion 32F.

The connection portions such as the first connection portion 9 and the intersection portion 14 in the traveling path 1 are provided with a guide rail 41 that guides the auxiliary guide wheels 39. The guide rail 41 is installed so as to be located above the traveling rail 3 as shown in FIG. 3, and to be located at the central part of the pair of left and right rail portions 3*a* in plan view as shown in FIG. 4.

The front traveling portion 32F is configured to move the position of the pair of front and rear auxiliary guide wheels 39 between a right guide position and a left guide position by moving the pair of front and rear auxiliary guide wheels 39 in the vehicle lateral width direction by the driving portion 40. At the right guide position, the pair of front and rear auxiliary guide wheels 39 are located on the right side of the center in the vehicle lateral width direction of the front traveling portion 32F, and the pair of front and rear auxiliary guide wheels 39 come into contact with the guide rail 41 from the right side. At the left guide position, the pair of front and rear auxiliary guide wheels 39 are located on the left side of the center in the vehicle lateral width direction of the front traveling portion 32F, and the pair of front and rear auxiliary guide wheels 39 come into contact with the guide rail 41 from the left side. As with the front traveling portion 32F, the rear traveling portion 32R is configured to move the pair of front and rear auxiliary guide wheels 39 between the right guide position and the left guide position by moving the pair of front and rear auxiliary guide wheels 39 in the vehicle lateral width direction by the driving portion 40.

The pair of front and rear auxiliary guide wheels 39 provided in the front traveling portion 32F and the pair of front and rear auxiliary guide wheels 39 provided in the rear traveling portion 32R are moved to the same guide position in a synchronized state. Further movement to the right of the right guide position and further movement to the left of the left guide position of the pair of left and right auxiliary guide wheels 39 are restricted by a restriction portion (not shown). Accordingly, for example, when the pair of front and rear auxiliary guide wheels 39 are pushed from the guide rail 41 from the right side in a state in which they are located at the right guide position, the pair of front and rear auxiliary guide wheels 39 are maintained at the right guide position by the restriction of the restriction portion. However, when the pair of front and rear auxiliary guide wheels 39 are pushed to the left side by the guide rail 41 in a state in which they are located at the right guide position, the pair of left and right auxiliary guide wheels 39 are moved toward the left guide position. That is, further movement to the left of the right guide position and further movement to the right of the left guide position of the pair of left and right auxiliary guide wheels 39 are not restricted. Therefore, the pair of left and right auxiliary guide wheels 39 can be moved from the right guide position to the left guide position, or be moved from the left guide position to the right guide position by an external force such as a pressing force applied by the guide rail 41.

Next, the traveling of the article transport vehicle 2 at the connection portions will be described, taking the first connection portion 9, as an example. As shown in FIG. 4, at the first connection portion 9, a first main path guide rail 41*a* installed along the first main path 5 and a first upstream guide rail 41*b* installed along the first upstream path 15 are installed as the guide rails 41. The right rail portion 3*a* of the pair of left and right rail portions 3*a* installed along the first main path 5 has a discontinuous part that is broken in the path longitudinal direction and is discontinuous so as to allow the passage of the coupling portions 34 and the pair of guide wheels 38 when the article transport vehicle 2 branches off from the first main path 5 to the first upstream path 15 on the right side.

When the article transport vehicle 2 traveling along the first main path 5 enters the first connection portion 9 in a state in which the two sets of the pair of front and rear auxiliary guide wheels 39 (hereinafter simply referred to as "auxiliary guide wheels 39") have been moved to the left guide position, the article transport vehicle 2 travels in a state in which the auxiliary guide wheels 39 are located on the left side of the first main path guide rail 41*a*. Accordingly, the auxiliary guide wheels 39 are guided by the first main path guide rail 41*a*, without being guided by the first upstream guide rail 41*b*. Consequently, the article transport vehicle 2 travels straight through the first connection portion 9.

When the article transport vehicle 2 travels straight through the first connection portion 9 of the first main path 5, a state occurs in which the right traveling wheel 37 of the pair of left and right traveling wheels 37 is not supported by the rail portion 3*a* in the discontinuous part of the right rail portion 3*a*. However, the rightward tilting of the article transport vehicle 2 is restricted by the auxiliary guide wheels 39 coming into contact with the first main path guide rail 41*a* from the left side. Likewise, when the article transport vehicle 2 travels straight through the first connection portion 9 of the first main path 5, a state occurs in which the right guide wheel 38 of the left and right guide wheels 38 is not guided by the rail portion 3*a* in the discontinuous part of the right rail portion 3*a*. However, instead of the right guide wheel 38, the auxiliary guide wheels 39 come into contact with the first main path guide rail 41*a* from the left side. Accordingly, the traveling portion 32 is guided along the first main path 5 in a state in which the movement in the vehicle lateral width direction is restricted by the auxiliary guide wheels 39 and the left guide wheel 38.

The article transport vehicle 2 traveling along the first main path 5 enters the first connection portion 9 in a state in which the auxiliary guide wheels 39 have been moved to the right guide position (the state shown in FIG. 4), and thereby, the article transport vehicle 2 travels in state in which the auxiliary guide wheels 39 are located on the right side of the first upstream guide rail 41*b*. Accordingly, the article transport vehicle 2 branches off at the first connection portion 9 in a state in which the auxiliary guide wheels 39 are guided by the first upstream guide rail 41*b*.

When the article transport vehicle 2 branches off at the first connection portion 9, the left traveling wheel 37 of the pair of left and right traveling wheels 37 moves over the communicating portion 3*b* between the pair of left and right rail portions 3*a* installed along the first main path 5. When the left traveling wheel 37 moves over the communicating portion 3*b*, a state occurs in which the traveling wheel 37 is not supported by the rail portion 3*a*. However, the leftward tilting of the article transport vehicle 2 is restricted by the auxiliary guide wheels 39 coming into contact with the first upstream guide rail 41*b* from the right side. Likewise, when the article transport vehicle 2 branches off at the first connection portion 9, a situation occurs in which the left guide wheel 38 of the left and right guide wheels 38 is not guided by the left-side rail portion 3*a*. However, instead of the left guide wheel 38, the auxiliary guide wheels 39 come into contact with the first upstream guide rail 41*b* from the right side. Accordingly, the traveling portion 32 is guided from the first main path 5 to the first upstream path 15 in a state in which the movement to the vehicle lateral width direction is restricted by the auxiliary guide wheels 39 and the right guide wheel 38.

Figure 5:
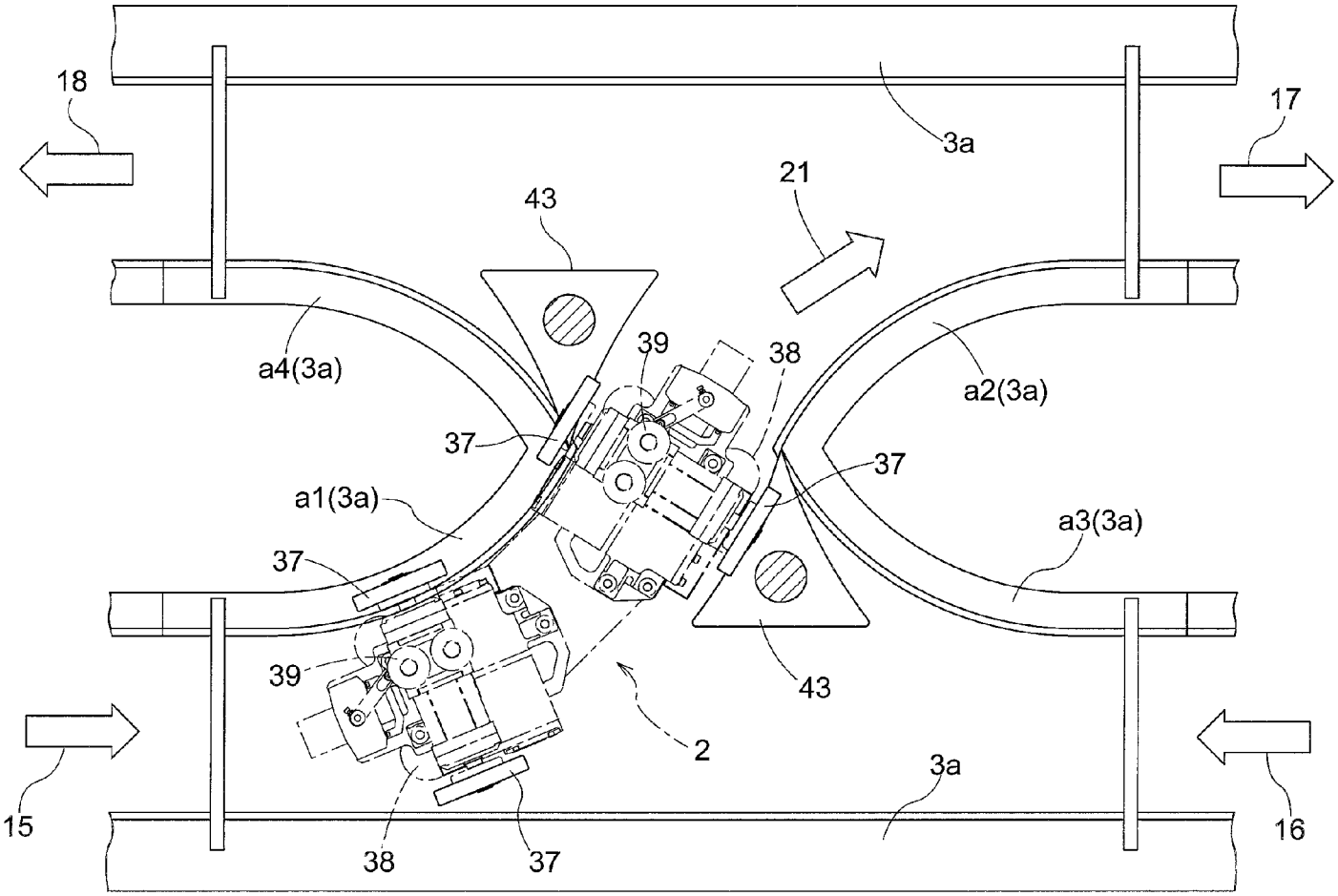
FIG. 5 is a plan view of an intersection portion in which a pair of movable rail portions are located at a first traveling position.

Next, the intersection portion 14 will be described. As shown in FIG. 5, as for the pair of left and right rail portions 3*a* installed along the first connection path 21, a rail portion 3*a* is provided on only one of the left and right sides in each of the upstream portion and the downstream portion of the first connection path 21 in the intersection portion 14. Specifically, in the upstream portion of the first connection path 21, only a left rail portion 3*a* (hereinafter referred to as "first left rail portion a1") located on the left side of the article transport vehicle 2 traveling along the first connection path 21 is provided, as shown in FIG. 5. In the downstream portion of the first connection path 21, only a right rail portion 3*a* (hereinafter referred to as "first right rail portion a2") located on the right side of the article transport vehicle 2 traveling along the first connection path 21 is provided.

Figure 6:
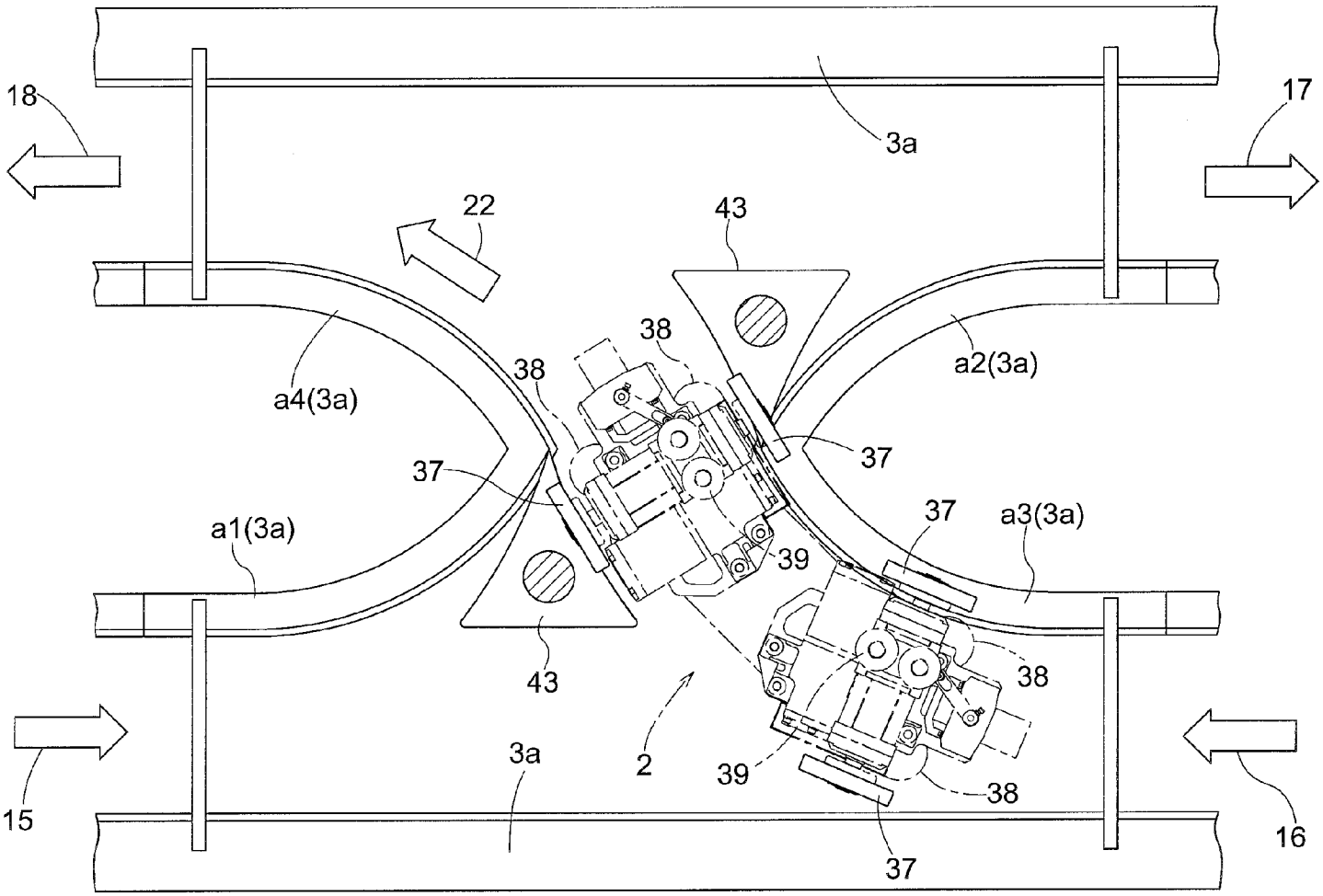
FIG. 6 is a plan view of the intersection portion in which the pair of movable rail portions are located at a second traveling position.

The same applies to the pair of left and right rail portions 3*a* installed along the second connection path 22. As shown in FIG. 6, in the upstream portion of the second connection path 22, only a right rail portion 3*a* (hereinafter referred to as "second right rail portion a3") located on the right side of the article transport vehicle 2 traveling along the second connection path 22 is provided. In the downstream portion of the second connection path 22, only a left rail portion 3*a* (hereinafter referred to as "second left rail portion a4") located on the left side of the article transport vehicle 2 traveling along the second connection path 22 is provided.

As shown in FIG. 5, the first left rail portion a1 and the first right rail portion a2 are installed spaced apart in the path longitudinal direction of the first connection path 21 so as to allow the passage of the coupling portions 34 and the pair of left and right guide wheels 38 of the article transport vehicle 2 when the article transport vehicle 2 travels along the second connection path 22. Accordingly, the traveling rail 3 provided along the first connection path 21 has a discontinuous section. Further, as shown in FIG. 6, the second right rail portion a3 and the second left rail portion a4 are installed spaced apart in the path longitudinal direction of the second connection path 22 so as to allow the passage of the coupling portion 34 and the pair of left and right guide wheels 38 of the article transport vehicle 2 when the article transport vehicle 2 travels along the first connection path 21. Accordingly, the traveling rail 3 provided along the second connection path 22 has a discontinuous section.

A pair of movable rail portions 43 that function as a pair of left and right rail portions 3*a* are provided in the intersection portion 14. The pair of movable rail portions 43 are configured to be switchable between a first traveling position (see FIG. 5) and a second traveling position (see FIG. 6). At the first traveling position, the pair of movable rail portions 43 are located so as to be continuous with the first left rail portion a1 and the first right rail portion a2, respectively, in the path longitudinal direction of the first connection path 21, and are spaced apart from each other in the path left-right direction of the first connection path 21 as with the first left rail portion a1 and the first right rail portion a2. At the second traveling position, the pair of movable rail portions 43 are located so as to be continuous with the second right rail portion a3 and the second left rail portion a4, respectively, in the path longitudinal direction of the second connection path 22, and are spaced apart from each other in the path left-right direction of the second connection path 22 as with the second right rail portion a3 and the second left rail portion a4.

Figure 7:
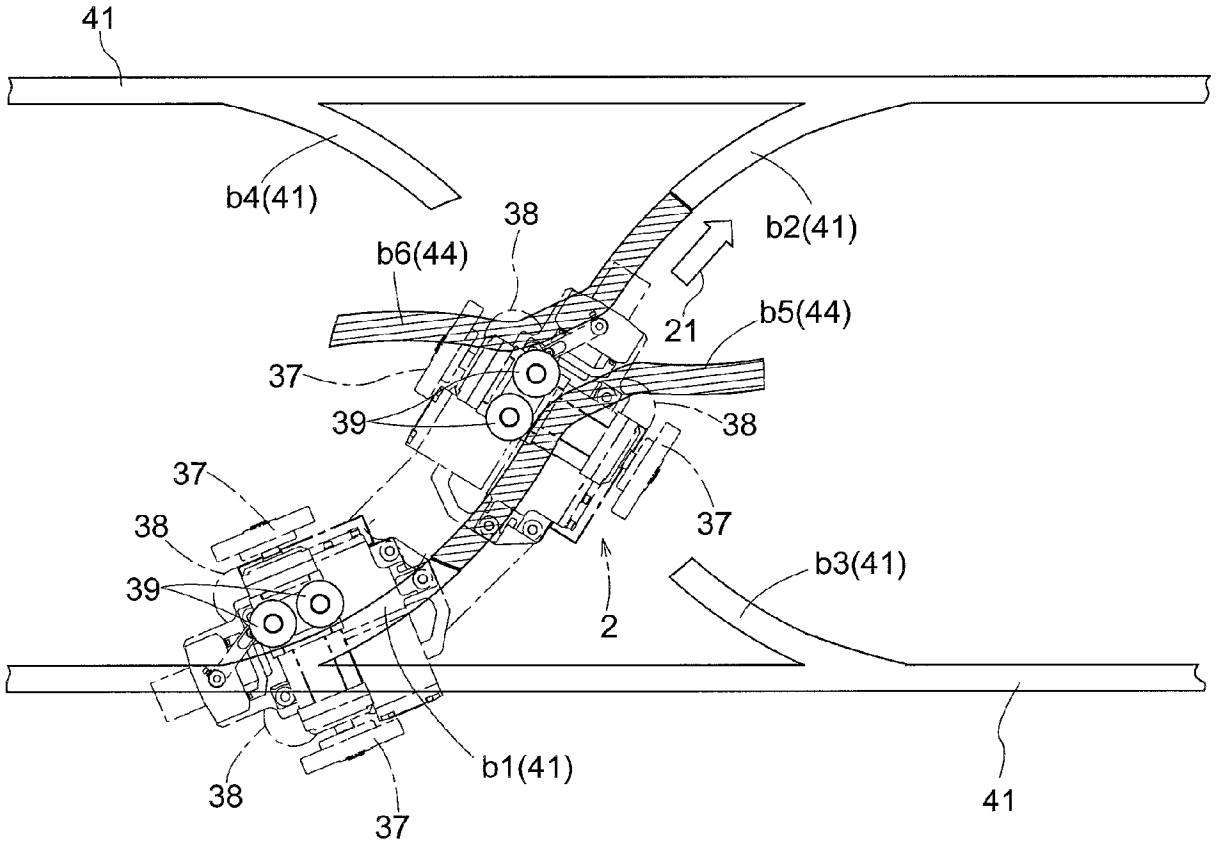
FIG. 7 is a plan view of the intersection portion in which a pair of movable guide rails are located at a first guide position.
Figure 8:
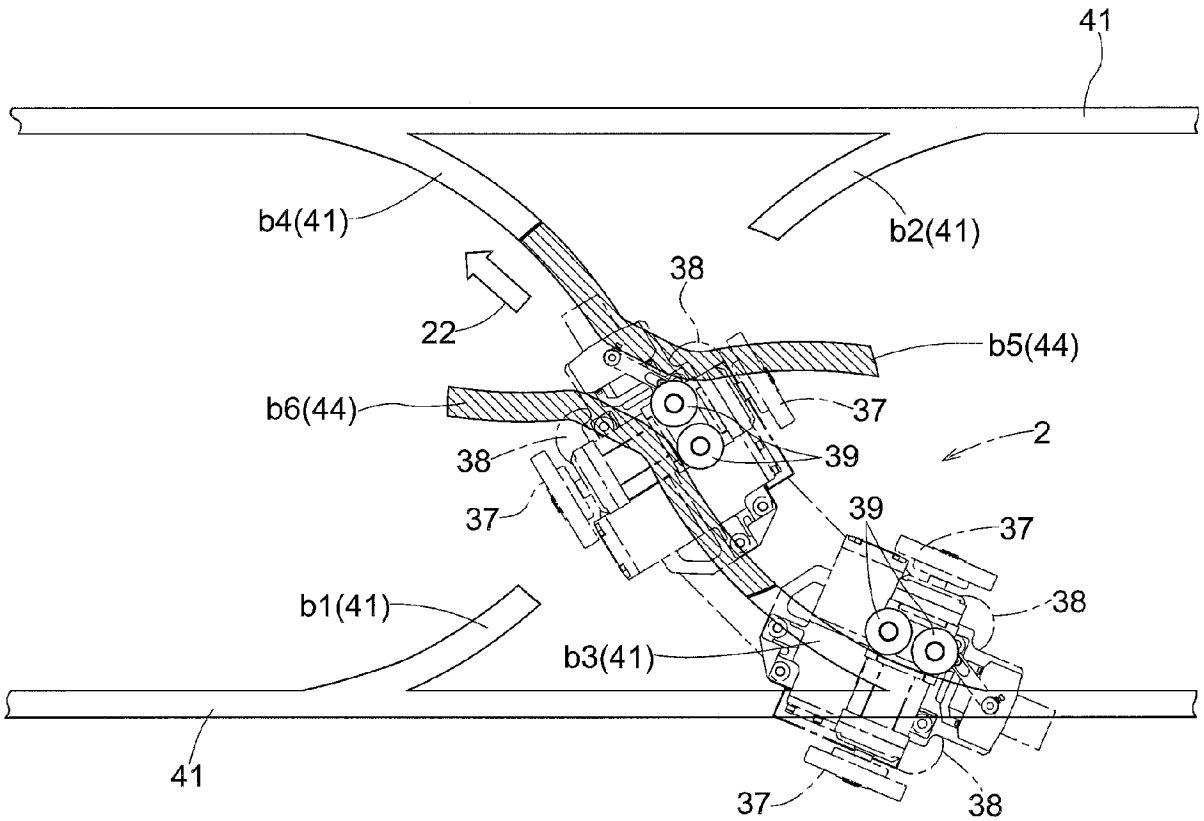
FIG. 8 is a plan view of the intersection portion in which the pair of movable guide rails are located at a second guide position.

As shown in FIGS. 7 and 8, four fixed guide rails (b1, b2, b3, and b4) are provided in the intersection portion 14. The first upstream guide rail b1 is a guide rail 41 provided along the upstream portion of the first connection path 21. The first downstream guide rail b2 is a guide rail 41 provided along the downstream portion of the first connection path 21. The second upstream guide rail b3 is a guide rail 41 provided along the upstream portion of the second connection path 22. The second downstream guide rail b4 is a guide rail 41 provided along the downstream portion of the second connection path 22. The first upstream guide rail b1 and the first downstream guide rail b2 are installed spaced apart in the path longitudinal direction of the first connection path 21 so as to allow the passage of the auxiliary guide wheels 39 of the article transport vehicle 2 when the article transport vehicle 2 travels along the second connection path 22. The second upstream guide rail b3 and the second downstream guide rail b4 are installed spaced apart in the path longitudinal direction of the second connection path 22 so as to allow the passage of the auxiliary guide wheels 39 of the article transport vehicle 2 when the article transport vehicle 2 travels along the first connection path 21.

As shown in FIGS. 7 and 8, a pair of movable guide rails 44 (a first movable guide rail b5 and a second movable guide rail b6) are further provided in the intersection portion 14. The pair of movable guide rails 44 are installed such that their orientation can be changed so as to be located between the first upstream guide rail b1 and the first downstream guide rail b2, or to be located between the second upstream guide rail b3 and the second downstream guide rail b4. In a state in which the pair of movable guide rails 44 are set at prescribed positions (a first guiding position and a second guiding position, described below), each of the movable guide rails 44 functions as the guide rail 41.

The pair of movable guide rails 44 are configured to be switchable between a first guiding position (see FIG. 7) and a second guiding position (see FIG. 8). As shown in FIG. 7, the first guiding position is a position at which the first movable guide rail b5 connects to the first upstream guide rail b1, and the second movable guide rail b6 connects to the first downstream guide rail b2. As shown in FIG. 8, the second guiding position is a position at which the first movable guide rail b5 connects to the second downstream guide rail b4, and the second movable guide rail b6 connects to the second upstream guide rail b3.

As shown in FIGS. 5 and 7, the article transport vehicle 2 traveling along the first upstream path 15 enters the intersection portion 14 in a state in which the auxiliary guide wheels 39 have been moved to the left guide position, and thereby, the article transport vehicle 2 travels in a state in which the auxiliary guide wheels 39 are located on the left side of the first upstream guide rail b1. Accordingly, in the upstream portion of the first connection path 21, the auxiliary guide wheels 39 are guided by the first upstream guide rail b1, and the article transport vehicle 2 changes its course to the left and travels from the first upstream path 15 to the upstream portion of the first connection path 21. When the article transport vehicle 2 travels from the first upstream path 15 to the upstream portion of the first connection path 21, a state occurs in which the right traveling wheel 37 of the pair of left and right traveling wheels 37 is not supported by the rail portion 3*a*. However, the rightward tilting of the article transport vehicle 2 is restricted by the auxiliary guide wheels 39 coming into contact with the first upstream guide rail b1 from the left side.

The first movable guide rail b5, which is one of the pair of movable guide rails 44 located at the first guide position, is connected to the first upstream guide rail b1. As the article transport vehicle 2 travels from the upstream portion to the midstream portion of the first connection path 21, the auxiliary guide wheels 39 are guided by the first movable guide rail b5 after being guided by the first upstream guide rail b1, and the article transport vehicle 2 travels in a state in which the rightward tilting thereof is restricted.

In the midstream portion of the first connection path 21, the transfer of the guide rail 41 is performed. Specifically, the auxiliary guide wheels 39 come into contact with the second movable guide rail b6, which is the other of the pair of movable guide rails 44 located at the first guide position. As described above, the pair of left and right auxiliary guide wheels 39 can be moved from the right guide position to the left guide position, or be moved from the left guide position to the right guide position by an external force such as a pressing force applied by the guide rail 41. As a result of the auxiliary guide wheels 39 being guided to the right side by the second movable guide rail b6, the auxiliary guide wheels 39 are moved from the left guide position to the right guide position. In this way, the pair of movable rail portions 43 are located at the first traveling position when the article transport vehicle 2 travels in the midstream portion. Since both of the pair of left and right traveling wheels 37 are supported by the movable rail portions 43, the transfer of the guide rail 41 can be performed in a stable manner.

In the downstream portion of the first connection path 21, the auxiliary guide wheels 39 are guided by the first downstream guide rail b2. The article transport vehicle 2 travels from the downstream portion of the first connection path 21 to the first downstream path 17. When the article transport vehicle 2 travels from the downstream portion of the first connection path 21 to the first downstream path 17, a state occurs in which the left traveling wheel 37 of the pair of left and right traveling wheels 37 is not supported by the rail portion 3*a*. However, the leftward tilting of the article transport vehicle 2 is restricted by the auxiliary guide wheels 39 coming into contact with the first downstream guide rail b2 from the right side. In this way, the article transport vehicle 2 traveling along the first upstream path 15 travels along the first connection path 21 of the intersection portion 14, and thereafter travels to the first downstream path 17 (see FIG. 5).

Note that the same applies to a case where the article transport vehicle 2 traveling along the second upstream path 16 travels along the second connection path 22 of the intersection portion 14, and thereafter travels to the second downstream path 18 (see FIG. 6). That is, as shown in FIG. 8, this case is the same as the case where the article transport vehicle 2 travels along the first connection path 21 except that the article transport vehicle 2 enters the intersection portion 14 in a state in which the auxiliary guide wheels 39 have been moved to the right guide position, that the pair of movable rail portions 43 are located at the second traveling position, and that the pair of movable guide rails 44 are located at the second guide position. Therefore, the detailed description has been omitted for the cases where the article transport vehicle 2 travels along the second upstream path 16, the second connection path 22, and the second downstream path 18.

Figure 10:
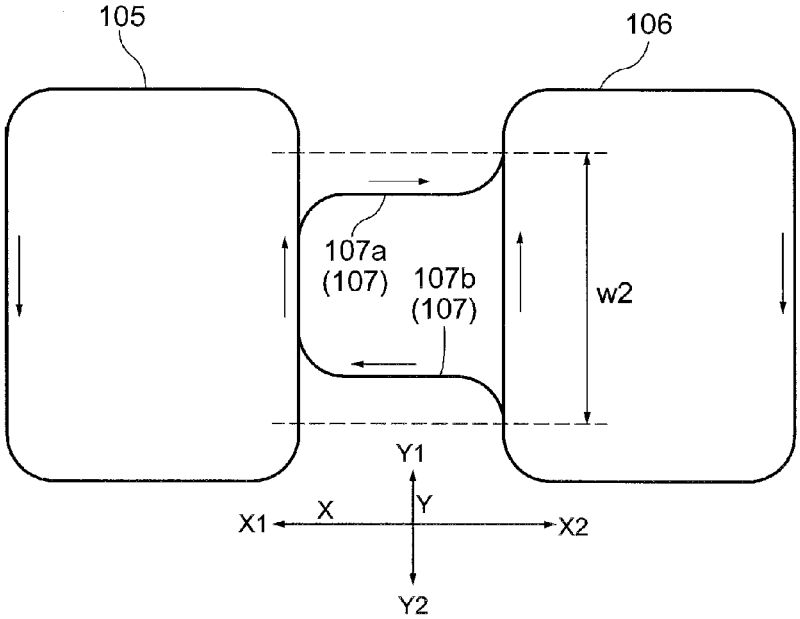
FIG. 10 is a diagram showing a state in which two sub-paths are arranged in a width direction.
Figure 11:
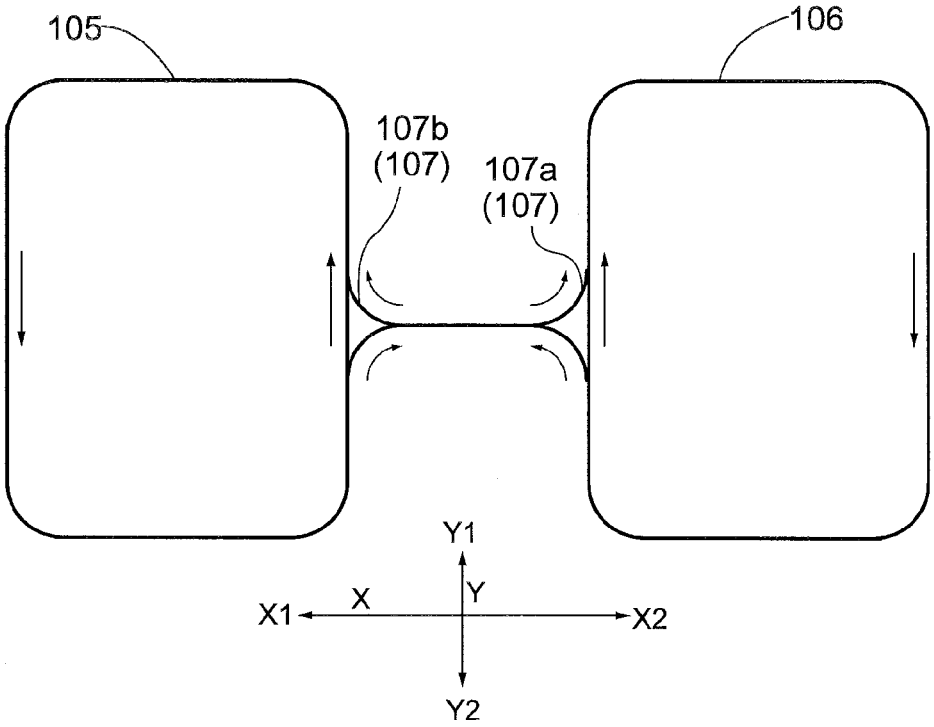
FIG. 11 is a diagram showing a state in which two sub-paths are arranged in a vertical direction.
Figure 12:
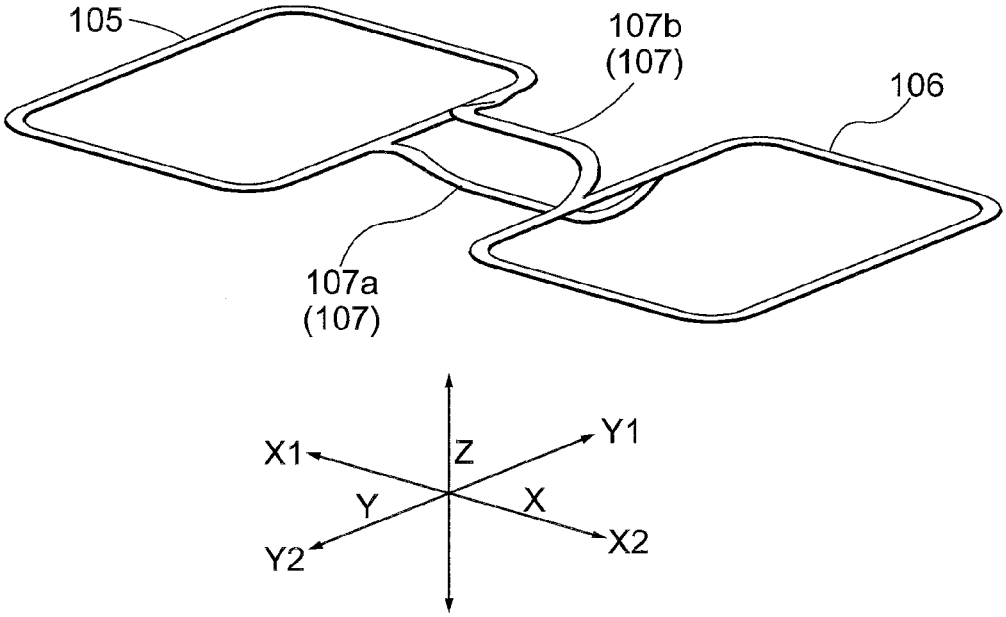
FIG. 12 is a perspective view showing the state in which two sub-paths are arranged in a vertical direction.

In this way, the article transport vehicle 2 that has branched off from the first connection portion 9 of the first main path 5 to the first upstream path 15 of the sub-path 7 travels along the sub-path 7, starting at the first upstream path 15, then the intersection portion 14 and the first downstream path 17 in this order, and thereafter merges with the second main path 6 (see FIG. 1). The article transport vehicle 2 that has branched off from the second connection portion 10 of the second main path 6 to the second upstream path 16 of the sub-path 7 travels along the sub-path 7, starting at the second upstream path 16, then the intersection portion 14 and the second downstream path 18 in this order, and thereafter merges with the first main path 5 (see FIG. 1). In the intersection portion 14, the path along which the article transport vehicle 2 that has branched off from the first main path 5 travels and the path along which the second main path 6 that has branched off from the article transport vehicle 2 travels intersect each other at the same height. Accordingly, it is possible to provide the sub-path 7 in a space that is narrow in the width direction Y and the vertical direction. For example, the space (W1) in the width direction Y that is required when the two paths (7*a* and 7*b*) are intersected each other can be smaller than the space (W2) in the width direction Y that is required when the two paths (107*a* and 107*b*) constituting the sub-path 7 are simply positioned so as to be arranged in the width direction (positioned in parallel) as illustrated in FIG. 10.

Figure 9:
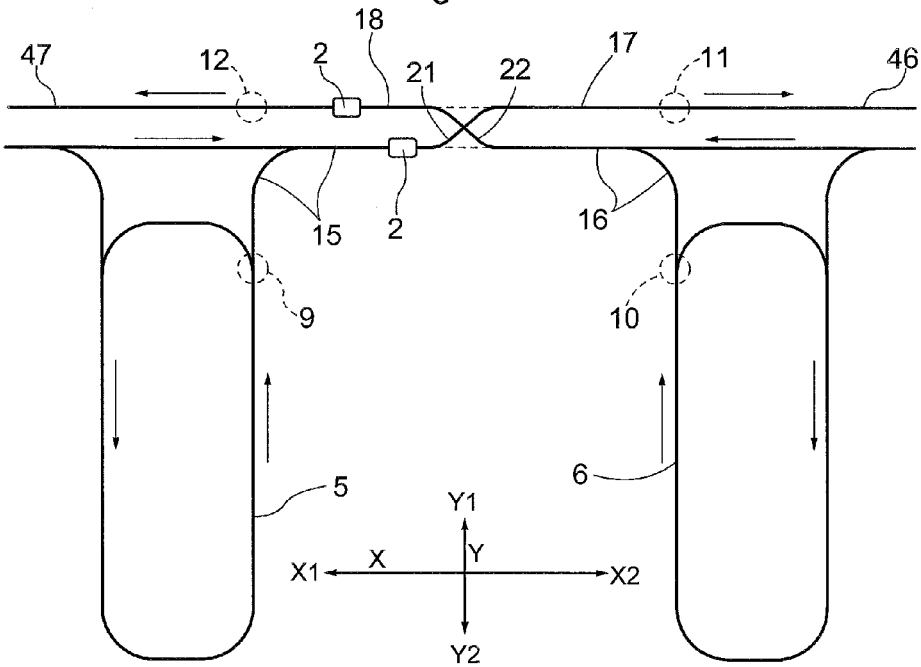
FIG. 9 is a diagram showing traveling paths according to an alternative embodiment.

Alternative Embodiments (1) The foregoing has illustrated a configuration in which the end in the second longitudinal direction X2 of the first downstream path 17 is connected to the second main path 6, and the end in the first longitudinal direction X1 of the second downstream path 18 is connected to the first main path 5, as shown in FIG. 1. That is, a configuration is illustrated in which the first downstream path 17 and the second main path 6 are connected at the third connection portion 11, and the second downstream path 18 and the first main path 5 are connected at the fourth connection portion 12. However, as shown in FIG. 9, the end in the second longitudinal direction X2 of the first downstream path 17 may be connected to a first different path 46 that is different from the first main path 5 and the second main path 6, and the end in the first longitudinal direction X1 of the second downstream path 18 may be connected to a second different path 47 that is different from the first main path 5 and the second main path 6. That is, it is also possible to adopt a configuration in which the first downstream path 17 and the first different path 46 are connected at the third connection portion 11, and the second downstream path 18 and the second different path 47 are connected at the fourth connection portion 12.

Specifically, the following configuration may be adopted. That is, as shown in FIG. 9, the first different path 46 located on the first width direction Y1 side of the second main path 6, and the second different path 47 located on the first width direction Y1 of the first main path 5 are provided as the traveling paths 1, in addition to the first main path 5, the second main path 6 and the sub-path 7. Then, the first connection portion 9 is provided at the end on the first width direction Y1 side of the first width direction path 5*a* of the first main path 5, and the second connection portion 10 is provided at the end on the first width direction Y1 side of the second width direction path 6*a* of the second main path 6. The article transport vehicle 2 that has branched off from the first connection portion 9 of the first main path 5 to the first upstream path 15 of the sub-path 7 travels along the sub-path 7, starting at the first upstream path 15, then the intersection portion 14 and the first downstream path 17 in this order, and thereafter travels along the first different path 46. The article transport vehicle 2 that has branched off from the second connection portion 10 of the second main path 6 to the second upstream path 16 of the sub-path 7 travels along the sub-path 7, starting at the second upstream path 16, then the intersection portion 14 and the second downstream path 18 in this order, and thereafter travels along the second different path 47.

(2) The foregoing has illustrated a configuration in which the third connection path 23 and the fourth connection path 24 are provided in the intersection portion 14, in addition to the first connection path 21 and the second connection path 22. However, it is also possible to adopt a configuration in which only the first connection path 21 and the second connection path 22 are provided in the intersection portion 14, without providing the traveling rail 3 and the guide rail 41 installed along the third connection path 23 and the fourth connection path 24 in the intersection portion 14.

Outline of the Embodiment

The following is a brief description of an outline of the embodiment of the article transport facility described above.

As an aspect, an article transport facility includes:

as traveling paths, a first main path that is formed in a loop shape, a second main path that is formed in a loop shape separately from the first main path, and a sub-path that connects the first main path and the second main path, the article transport facility being configured to transport an article by an article transport vehicle that travels along the traveling paths only in a direction of forward movement, wherein the sub-path includes a first sub-path connected to the first main path at a first connection portion, and a second sub-path connected to the second main path at a second connection portion, a direction of arrangement of the first main path and the second main path is set to be a longitudinal direction, a direction extending from the second main path toward the first main path in the longitudinal direction is set to be a first longitudinal direction, and a direction extending from the first main path toward the second main path in the longitudinal direction is set to be a second longitudinal direction, a direction orthogonal to the longitudinal direction in plan view is set to be a width direction, one direction extending along the width direction is set to be a first width direction, and another direction extending along the width direction is set to be a second width direction, the first main path and the second main path are paths along which the article transport vehicle travels in directions opposite to each other, the sub-path includes:

an intersection portion that is located between the first main path and the second main path in the longitudinal direction and in which the first sub-path and the second sub-path intersect each other;

a first upstream path whose end on the first longitudinal direction side is connected to the first connection portion and whose end on the second longitudinal direction side is connected to the intersection portion;

a second upstream path whose end on the second longitudinal direction side is connected to the second connection portion and whose end on the first longitudinal direction side is connected to the intersection portion;

a first downstream path that is located on the first width direction side with respect to the second upstream path, and whose end on the first longitudinal direction side is connected to the intersection portion and whose end on the second longitudinal direction side is connected to a first different path different from the first main path at a third connection portion; and a second downstream path that is located on the first width direction side with respect to the first upstream path, and whose end on the second longitudinal direction side is connected to the intersection portion and whose end on the first longitudinal direction side is connected to a second different path different from the second main path at a fourth connection portion, the first upstream path and the first downstream path are paths along which the article transport vehicle travels in the second longitudinal direction, the second upstream path and the second downstream path are paths along which the article transport vehicle travels in the first longitudinal direction, the intersection portion includes a first connection path that connects the end on the second longitudinal direction side of the first upstream path and the end on the first longitudinal direction side of the first downstream path, and a second connection path that connects the end on the first longitudinal direction side of the second upstream path and the end on the second longitudinal direction side of the second downstream path, and the first connection path and the second connection path are provided so as to be located at the same height and to intersect each other.

With this configuration, the article transport vehicle that has branched off from the first connection portion of the first main path to the first upstream path of the sub-path travels along the sub-path, starting at the first upstream path, then the intersection portion and the first downstream path in this order, and thereafter merges with the second main path or travels along a first different path. The article transport vehicle that has branched off from the second connection portion of the second main path to the second upstream path of the sub-path travels along the sub-path, starting at the second upstream path, then the intersection portion and the second downstream path in this order, and thereafter merges with the first main path or travels along a second different path.

The path (the first upstream path, the intersection portion, and the first downstream path) along which the article transport vehicle that has branched off from the first main path travels and the path (the second upstream path, the intersection portion, and the second downstream path) along which the article transport vehicle that has branched off from the second main path intersect each other at the same height in the intersection portion. Therefore, it is possible to provide the first upstream path close to the second downstream path in the second width direction, and provide the first downstream path close to the second upstream path in the first width direction.

Accordingly, even when the end on the first longitudinal direction side of the first upstream path that is connected to the first main path and the end of the second upstream path that is connected to the second main path are formed in an arc shape in plan view so as to allow the article transport vehicle to smoothly branch off, it is not necessary to significantly shift these ends in the width direction of the sub-path. Accordingly, it is possible to provide the sub-path without requiring a wide space in the width direction. Further, even when these ends are provided at the same position in the width direction, the path (the first upstream path, the intersection portion, and the first downstream path) of the sub-path along which the article transport vehicle that has branched off from the first main path travels and the path (the second upstream path, the intersection portion, and the second downstream path) thereof along which the article transport vehicle that has branched off from the second main path travels do not need to be set so as to be shifted in the vertical direction. Accordingly, it is possible to provide the sub-path without requiring a wide space in the vertical direction as well, and also prevent the structure from becoming more complex due to a three-dimensional intersection. In this way, with the present configuration, it is possible to provide the sub-path in a space that is narrow in the path width direction and the vertical direction.

Here, it is preferable that the first downstream path and the second main path are connected at the third connection portion, and the second downstream path and the first main path are connected at the fourth connection portion.

With this configuration, the article transport vehicle that has branched off from the first connection portion of the first main path to the first upstream path of the sub-path can transfer to the second main path by traveling along the sub-path, starting at the first upstream path, then the intersection portion and the first downstream path in this order, and thereafter merging with the second main path. The article transport vehicle that has branched off from the second connection portion of the second main path to the second upstream path of the sub-path can transfer to the first main path by traveling the sub-path, starting at the second upstream path, then the intersection portion and the second downstream path in this order, and thereafter merging with the first main path. Then, the sub-path that allows the article transport vehicle to transfer from the first main path to the second main path, and allows the article transport vehicle to transfer from the second main path to the first main path in this way can be provided in a space that is narrow in the width direction and the vertical direction.

Further, it is preferable that the first different path is located on the first width direction side of the second main path, the second different path is located on the first width direction side of the first main path, the first downstream path and the first different path are connected at the third connection portion, and the second downstream path and the second different path are connected at the fourth connection portion.

With this configuration, the article transport vehicle that has branched off from the first connection portion of the first main path to the first upstream path of the sub-path travels along the sub-path, starting at the first upstream path, then the intersection portion and the first downstream path in this order, and thereafter travels along the first different path located in the first width direction of the second main path. The article transport vehicle that has branched off from the second connection portion of the second main path to the second upstream path of the sub-path travels along the sub-path, starting at the second upstream path, then the intersection portion and the second downstream path in this order, and thereafter travels along the second different path located in the first width direction of the first main path. In this way, the path from the first main path to the first different path and the path from the second main path to the second different path can be provided in a space that is narrow in the width direction and the vertical direction, and the travel distance of the article transport vehicle can also be shortened.

Here, it is preferable that the first width direction is a direction in which the article transport vehicle travels along the width direction in each of a path of the first main path that opposes the second main path and a path of the second main path that opposes the first main path, the first connection portion is provided in a path along which the article transport vehicle travels in the first width direction along the first main path, and the second connection portion is provided in a path along which the article transport vehicle travels in the first width direction along the second main path.

Since the first connection portion and the second connection portion are provided on the side where the first main path and the second main path oppose each other, it is possible to provide the sub-path in a short distance.

Further, when the first width direction is a direction in which the article transport vehicle travels along the width direction in each of a path of the first main path that opposes the second main path and a path of the second main path that opposes the first main path, the first downstream path is connected to the second main path at the third connection portion, and the second downstream path is connected to the first main path at the fourth connection portion, it is preferable that the first connection portion and the fourth connection portion are provided in a path along which the article transport vehicle travels in the first width direction along the first main path, and the second connection portion and the third connection portion are provided in a path along which the article transport vehicle travels in the first width direction along the second main path.

Since the first connection portion, the second connection portion, the third connection portion, and the fourth connection portion are provided on the side where the first main path and the second main path oppose each other, it is possible to provide the sub-path in a short distance.

Here, it is preferable that the third connection portion is located on the first width direction side with respect to the second connection portion, and the fourth connection portion is located on the first width direction side with respect to the first connection portion.

With this configuration, the first sub-path that connects the first connection portion and the third connection portion and the second sub-path that connects the second connection portion and the fourth connection portion appropriately intersect each other in the intersection portion, making it possible to appropriately reduce the width direction length of the sub-path in the width direction.

Further, it is preferable that the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

Figure 13:
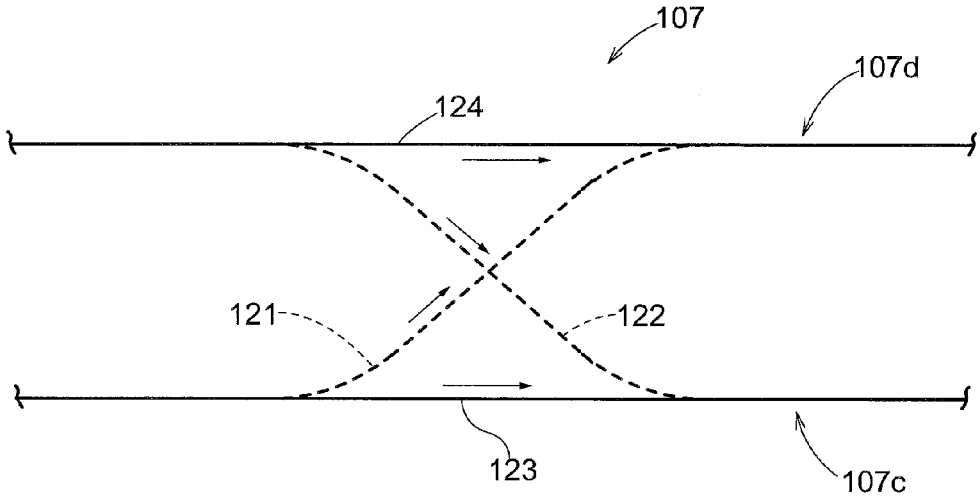
FIG. 13 is a diagram showing an example of two parallel sub-paths along which the article transport vehicle travels in the same direction.

FIG. 13 illustrates two parallel paths (107*c* and 107*d*) along which the article transport vehicle travels in the same direction in the longitudinal direction X as a sub-path (107). The paths (121 and 122) indicated by the broken lines in FIG. 13 show connection paths that allow the article transport vehicle to transfer between the two parallel paths (107*c* and 107*d*). In this case, it can be said that the paths denoted by reference numerals 123 and 124 are connection paths that are used when the article transport vehicle moves straight through each of the two parallel paths (107*c* and 107*d*). Accordingly, assuming that the location where the paths (121 and 122) indicated by the broken lines are provided is the intersection portion, it can be said that the sub-path (107) shown in FIG. 13 includes an intersection portion including four connection paths (121, 122, 123, and 124) having the same positional relationship as that of the above-described first connection path, second connection path, third connection path, and fourth connection path. Such a sub-path (107) has been used, for example, when an article transport vehicle is caused to transfer between two parallel paths along which the article transport vehicle travels in the same direction in the longitudinal direction X.

The inventors have found that the path denoted by reference numeral 122 that corresponds to the second connection path enables the article transport vehicle to travel in the opposite direction in the longitudinal direction X from the direction of traveling of the article transport vehicle traveling along the path denoted by reference numeral 121 that corresponds to the first connection path in such an intersection portion (107). That is, the inventors have found that such an intersection portion can be used as a path interchanging intersection portion when interchanging the order of arrangement in the width direction Y of two paths (e.g., 107*a* and 107*b* illustrated in FIG. 10) along which the article transport vehicles travel in opposite directions between the upstream side and the downstream side. For example, an intersection portion provided for transfer between paths in an existing facility can also be used as an intersection portion for interchanging the positions in the path width direction. This makes it possible to reduce the cost for improving the function of the article transport facility as compared with when a dedicated intersection portion is provided.

The invention claimed is:

1. An article transport facility comprising:

as traveling paths, a first main path that is formed in a loop shape, a second main path that is formed in a loop shape separately from the first main path, and a sub-path that connects the first main path and the second main path, the article transport facility being configured to transport an article by an article transport vehicle that travels along the traveling paths only in a direction of forward movement, wherein the sub-path includes a first sub-path connected to the first main path at a first connection portion, and a second sub-path connected to the second main path at a second connection portion, a direction of arrangement of the first main path and the second main path is set to be a longitudinal direction, a direction extending from the second main path toward the first main path in the longitudinal direction is set to be a first longitudinal direction, and a direction extending from the first main path toward the second main path in the longitudinal direction is set to be a second longitudinal direction, a direction orthogonal to the longitudinal direction in plan view is set to be a width direction, one direction extending along the width direction is set to be a first width direction, and another direction extending along the width direction is set to be a second width direction, the first main path and the second main path are paths along which the article transport vehicle travels in directions opposite to each other, wherein the sub-path includes:

an intersection portion that is located between the first main path and the second main path in the longitudinal direction and in which the first sub-path and the second sub-path intersect each other;

a first upstream path whose end on the first longitudinal direction side is connected to the first connection portion and whose end on the second longitudinal direction side is connected to the intersection portion;

a second upstream path whose end on the second longitudinal direction side is connected to the second connection portion and whose end on the first longitudinal direction side is connected to the intersection portion;

a first downstream path that is located on the first width direction side with respect to the second upstream path, and whose end on the first longitudinal direction side is connected to the intersection portion and whose end on the second longitudinal direction side is connected to a first different path different from the first main path at a third connection portion; and a second downstream path that is located on the first width direction side with respect to the first upstream path, and whose end on the second longitudinal direction side is connected to the intersection portion and whose end on the first longitudinal direction side is connected to a second different path different from the second main path at a fourth connection portion, the first upstream path and the first downstream path are paths along which the article transport vehicle travels in the second longitudinal direction, the second upstream path and the second downstream path are paths along which the article transport vehicle travels in the first longitudinal direction, the intersection portion includes a first connection path that connects the end on the second longitudinal direction side of the first upstream path and the end on the first longitudinal direction side of the first downstream path, and a second connection path that connects the end on the first longitudinal direction side of the second upstream path and the end on the second longitudinal direction side of the second downstream path, and the first connection path and the second connection path are provided so as to be located at the same height and to intersect each other.

2. The article transport facility according to claim 1, wherein the first downstream path and the second main path are connected at the third connection portion, and the second downstream path and the first main path are connected at the fourth connection portion.

3. The article transport facility according to claim 2, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

4. The article transport facility according to claim 2, wherein the first width direction is a direction in which the article transport vehicle travels along the width direction in each of a path of the first main path that opposes the second main path and a path of the second main path that opposes the first main path, the first connection portion and the fourth connection portion are provided in a path along which the article transport vehicle travels in the first width direction along the first main path, and the second connection portion and the third connection portion are provided in a path along which the article transport vehicle travels in the first width direction along the second main path.

5. The article transport facility according to claim 4, wherein the third connection portion is located on the first width direction side with respect to the second connection portion, and the fourth connection portion is located on the first width direction side with respect to the first connection portion.

6. The article transport facility according to claim 5, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

7. The article transport facility according to claim 4, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

8. The article transport facility according to claim 2, wherein:

the first width direction is a direction in which the article transport vehicle travels along the width direction in each of a path of the first main path that opposes the second main path and a path of the second main path that opposes the first main path, the first connection portion is provided in a path along which the article transport vehicle travels in the first width direction along the first main path, and the second connection portion is provided in a path along which the article transport vehicle travels in the first width direction along the second main path.

9. The article transport facility according to claim 8, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

10. The article transport facility according to claim 1, wherein:

the first different path is located on the first width direction side of the second main path, the second different path is located on the first width direction side of the first main path, the first downstream path and the first different path are connected at the third connection portion, and the second downstream path and the second different path are connected at the fourth connection portion.

11. The article transport facility according to claim 10, wherein:

the first width direction is a direction in which the article transport vehicle travels along the width direction in each of a path of the first main path that opposes the second main path and a path of the second main path that opposes the first main path, the first connection portion is provided in a path along which the article transport vehicle travels in the first width direction along the first main path, and the second connection portion is provided in a path along which the article transport vehicle travels in the first width direction along the second main path.

12. The article transport facility according to claim 11, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

13. The article transport facility according to claim 1, wherein:

the first width direction is a direction in which the article transport vehicle travels along the width direction in each of a path of the first main path that opposes the second main path and a path of the second main path that opposes the first main path, the first connection portion is provided in a path along which the article transport vehicle travels in the first width direction along the first main path, and the second connection portion is provided in a path along which the article transport vehicle travels in the first width direction along the second main path.

14. The article transport facility according to claim 10, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

15. The article transport facility according to claim 13, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

16. The article transport facility according to claim 1, wherein the intersection portion includes a third connection path that connects the end on the second longitudinal direction side of the first upstream path and the end on the first longitudinal direction side of the second upstream path, and a fourth connection path that connects the end on the second longitudinal direction side of the second downstream path and the end on the first longitudinal direction side of the first downstream path.

* * * * *